US008407835B1

(12) United States Patent
Connor

(10) Patent No.: US 8,407,835 B1
(45) **Date of Patent: *Apr. 2, 2013**

(54) CONFIGURATION-CHANGING SLEEPING ENCLOSURE

(75) Inventor: Robert A. Connor, Minneapolis, MN (US)

(73) Assignee: Medibotics LLC, Forest Lake, MN (US)

( * ) Notice: Subject to any disclaimer, the term of this patent is extended or adjusted under 35 U.S.C. 154(b) by 377 days.

This patent is subject to a terminal disclaimer.

(21) Appl. No.: 12/584,695

(22) Filed: Sep. 10, 2009

(51) Int. Cl.

| | |
|---|---|
| ***A47C 29/00*** | (2006.01) |
| ***A47C 21/04*** | (2006.01) |
| ***E04H 15/02*** | (2006.01) |
| ***E04H 15/36*** | (2006.01) |

(52) U.S. Cl. ..... 5/309; 5/414; 5/423; 5/284; 135/96; 135/124

(58) Field of Classification Search ..... 5/423, 414, 5/424, 512, 513, 309, 284, 421, 113, 415, 5/416; 135/96, 124, 137, 116; 128/202.12; 600/21, 22

See application file for complete search history.

(56) References Cited

U.S. PATENT DOCUMENTS

| | | | | |
|---|---|---|---|---|
| 2,375,941 | A | | 5/1945 | Nostrand |
| 3,323,147 | A | | 6/1967 | Dean |
| 3,748,799 | A | | 7/1973 | Tough et al. |
| 4,017,917 | A | | 4/1977 | Brown |
| 4,079,162 | A | | 3/1978 | Metzger |
| 4,109,331 | A | | 8/1978 | Champeau |
| 4,129,123 | A | | 12/1978 | Smidak |
| 4,305,168 | A | | 12/1981 | Holter et al. |
| 4,377,195 | A | | 3/1983 | Weil |
| 4,513,041 | A | | 4/1985 | Delluc |
| 4,594,817 | A | | 6/1986 | McLaren et al. |
| 4,641,387 | A | | 2/1987 | Bondy et al. |
| 4,937,903 | A | | 7/1990 | Joly et al. |
| 5,018,328 | A | | 5/1991 | Cur et al. |
| D335,589 | S | * | 5/1993 | Benedict ..... D6/389 |
| 5,384,925 | A | | 1/1995 | Vail |
| 5,411,623 | A | | 5/1995 | Shutt |
| 5,560,058 | A | | 10/1996 | Smith |
| 5,669,088 | A | | 9/1997 | McNamee |
| 5,844,996 | A | | 12/1998 | Enzmann et al. |
| 5,867,957 | A | | 2/1999 | Holtrop |
| 5,896,710 | A | | 4/1999 | Hoyle |
| 5,964,222 | A | * | 10/1999 | Kotliar ..... 128/205.26 |
| 6,014,345 | A | | 1/2000 | Schmadeka |
| 6,153,135 | A | | 11/2000 | Novitsky |
| 6,216,291 | B1 | | 4/2001 | Eads et al. |
| 6,263,529 | B1 | | 7/2001 | Chadwick et al. |
| 6,308,466 | B1 | | 10/2001 | Moriarty |
| 6,360,384 | B1 | * | 3/2002 | Kuempel ..... 5/414 |
| 6,446,751 | B1 | | 9/2002 | Ahuja et al. |
| 6,461,290 | B1 | | 10/2002 | Reichman et al. |
| 6,487,735 | B1 | | 12/2002 | Jacques et al. |
| 6,508,850 | B1 | | 1/2003 | Kotliar |
| 6,694,547 | B1 | | 2/2004 | Vail |
| 6,772,458 | B2 | | 8/2004 | Ellen et al. |
| 6,827,760 | B2 | | 12/2004 | Kutt et al. |
| 7,047,991 | B2 | | 5/2006 | Kline |
| 7,063,184 | B1 | | 6/2006 | Johnson |

(Continued)

*Primary Examiner* — Robert G Santos

(57) ABSTRACT

This invention is a sound-insulating enclosure that contains at least one bed, in which one or more people sleep, wherein the configuration of this enclosure automatically changes from a more-closed configuration to a more-open configuration over time, or vice versa. These changes in configuration can be in response to sounds or can occur in a pre-programmed manner.

14 Claims, 3 Drawing Sheets

U.S. PATENT DOCUMENTS

| | | | | |
|---|---|---|---|---|
| 7,380,296 | B2 | 6/2008 | Ellen et al. | |
| 7,434,280 | B2 | 10/2008 | Cyr | |
| 8,276,223 | B1 * | 10/2012 | Connor | 5/423 |
| 2004/0234080 | A1 * | 11/2004 | Hernandez et al. | 381/71.11 |
| 2006/0020159 | A1 * | 1/2006 | Ellen | 600/21 |
| 2007/0125010 | A1 | 6/2007 | Papakonstantinou | |
| 2007/0294827 | A1 | 12/2007 | Carr et al. | |
| 2008/0276371 | A1 * | 11/2008 | Stowers | 5/513 |
| 2009/0162599 | A1 | 6/2009 | Rickards | |

* cited by examiner

CONFIGURATION-CHANGING SLEEPING ENCLOSURE

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field of Invention

This invention relates to enclosures that insulate people from sleep-disturbing noises.

Sleep Deprivation in an Increasingly Noisy World

Many people live and sleep in places that are increasingly noisy. Our modern world is permeated by: intrusive sound systems with powerful bass speakers that penetrate apartment walls, video games with loud explosions and sound effects, vehicles with thumping bass speakers, jet and train traffic at all hours of the day and night, sirens and heavy equipment, dogs that bark incessantly, and so forth. The list of noise pollution sources grows each year. High noise levels are bad enough during daylight hours, but can be especially devastating at night when one is trying to sleep. Lack of sleep due to environmental noise can wreak havoc on one's health, productivity, and overall quality of life. Sleep-disturbing noise can even come from members of one's own household. For example, loud snoring can have devastating effects on one's closest personal relationships.

Some people can afford to live in places that are far removed from the flight paths of major airports, but other people can not. Some people can afford to live far away from establishments that play loud music until the early morning hours, but other people can not. Some people can afford to have living arrangements with multiple bedrooms so that they do not have to choose between a close relationship and getting enough sleep to face the next day, but other people can not. For many people, sleep deprivation is a vicious cycle. Sleep deprivation hinders them from earning more income, the limited income limits their living options, and the limited living options result in more sleep deprivation. What can be done to break this cycle to help people to get a decent night's sleep in today's increasingly noisy world?

For all of these reasons, there is a significant and growing need for safe methods to reduce exposure to intrusive sounds so that people can get a decent night's sleep. There are methods in the related art that reduce a sleeper's exposure to environmental sounds. However, as we will discuss, these methods in the related art have significant limitations. A very-real unmet need remains. The invention disclosed herein is designed to meet this need in an innovative, safe, and useful manner. There does not appear to be anything in the prior art that anticipates this invention. This invention can help many people to avoid the devastation of chronic sleep deprivation on their health, relationships, productivity and overall quality of life.

There are two general approaches in the related art that are directed toward reducing the detrimental effects of sleep-disturbing noise. The first approach involves generating sounds that cancel the sleep-disturbing noise ("noise cancellation) or mask the sleep-disturbing noise ("noise masking"). The second approach involves the use of sound-insulating structures or enclosures that block the sleep-disturbing noise from reaching the sleeper. We now discuss both of these approaches and their limitations. Following that, we describe the current invention and discuss how it addresses these limitations in an innovative and useful manner.

2. Related Art

Noise Cancellation and Noise Masking

"Noise cancellation" involves monitoring the environment for sleep-disturbing noise and then custom-generating noise-canceling sounds that have a wave structure that is symmetrically-opposite to the sleep-disturbing noise. Ideally, when the sleep-disturbing sound waves and the custom-generated sound waves overlap, their acoustic energies cancel each other out because their wave patterns are symmetrically-opposite to each other. Although appealing in theory, such noise cancellation can be difficult to do well in practice. For example, generation of sounds in order to cancel the environmental noise is not instantaneous. The environmental noise must be detected and analyzed. This creates a lag between the two sounds. If the environmental noise is relatively continuous, then this lag need not be a problem. However, if the environmental noise is intermittent or highly-variable, then the lag is a problem. Then the lagged sound waves do not cancel each other out.

One solution to address the lag problem is to have the noise monitor be closer to the noise source than the speaker that emits the custom-generated sounds and the sleeper's ear. However, this solution to the lag problem only works if the environmental noise consistently comes from the same direction. This solution breaks down when environmental noise comes from different directions. Noise-cancellation headphones can come close to canceling noise from any direction. However, many people do not like to wear headphones when they sleep and even headphones do not completely eliminate the lag problem. For these reasons, active noise cancellation is not an ideal solution for reducing sleepers' exposure to environmental noise.

"Noise masking" involves playing sounds that cover up (but do not cancel) intrusive environmental noise. Many noise masking devices create sounds with a broad-spectrum of frequencies, such as "white noise" or "pink noise," that cover up noise at random. Other noise masking devices offer a menu of sounds from which the sleeper can select to cover up particular environmental sounds. Both types of noise masking have limitations. Broad-spectrum random sounds (such as "white noise" or "pink noise") may not be powerful or targeted enough to mask certain sounds, such as those with powerful bass frequencies. Sounds selected from a menu of sounds may have gaps between sounds or repetition in prerecording sound loops that let the environmental sounds come through periodically or may themselves become annoying.

An overall limitation of using one sound to cover up another sound is analogous to using one smell to cover up another smell. Sometimes the sensory organ is just not fooled. For example, trying to cover up the smell of a wet dog with a flower scent might not fool one's nose. Trying to cover up a bass beat from the party next door with the sound of a bubbling waterfall might not fool one's ears. The combined effect can sometimes be doubly annoying, not relaxing.

Some of the many examples in the related art that appear to use noise cancellation or noise masking include U.S. Pat. Nos. 5,844,996 (Enzmann et al., 1998), and 6,014,345 (Schmadeka, 2000).

3. Related Art

Sound-Insulating Sleeping Structures

Sound-insulating structures and enclosures in which one or more people sleep can block some or all of the sleep-disturbing noise from the environment that would otherwise reach them. However, such structures have a central limitation that has not yet been solved in the prior art. This central limitation concerns the degree to which the structure fully encloses the sleeper. A structure that fully encloses the sleeper with no gaps in its walls (but does have active ventilation to provide fresh air) can thoroughly insulate a sleeper from sleep-disturbing environmental noise. However, many people do not like the "closed in" feeling of sleeping in a fully-enclosed structure if this can be avoided. They prefer a more open structure with one or more good-sized openings. Much of the related art on sound-insulating sleeping enclosures involves attempts to find the "optimal balance" between: the sound-blocking benefits of a fully-enclosed sleeping structure on the one hand vs. the aesthetic/ventilation benefits of a relatively-open sleeping structure on the other hand.

This problem is compounded because the "optimal balance" between a structure that is more open vs. a structure that is more closed often depends on circumstances and these circumstances change over time. The "optimal balance" can even change during the course of one night. For example, suppose that there is a wild party in the apartment next door and that thumping bass comes through your walls until 3 am. Under these circumstances, you may be willing to tolerate the aesthetic unpleasantness of sleeping in a relatively closed structure (as long as there is active ventilation) in order to get to sleep. However, when the circumstances change and the party stops at 3 am, then you may prefer a relatively open sleeping structure (more like a conventional bed) for aesthetic reasons and for natural ventilation. Conversely, if all is calm when you go to bed at 11 pm, then you may enjoy going to sleep in an open sleeping structure. However, when circumstances change and dog next door begins barking at nothing between 3 am and 4 am, then an enclosed structure may be preferred.

Frazzled and frustrated sleepers have struggled with changing circumstances such as these for decades. The classic image that comes to mind is that of a person who tosses and turns, placing pillows and blankets over their ears, during the course of the night. Unfortunately, pillows and blankets do not provide good sound insulation. Alternatively, if a sleeper can afford both a traditional open bed and one of the relatively-closed sound-insulating structures (with active ventilation) in the related art, then they might move back and forth from one to the other during the night with changes in environmental noise levels. However, this is resource intensive and such movement itself can disrupt one's sleep. None of the structures in the related art offer a sound-insulating solution that automatically changes from an open configuration to a closed configuration in response to changes in sound levels. This present invention provides such a solution.

Examples of sound-insulating structures for sleeping that are relatively open (having openings, screens, or nets) include the following: U.S. Pat. Nos. 2,375,941 (Nostrand, 1945), 3,323,147 (Dean, 1967), 4,377,195 (Weil, 1983), 5,560,058 (Smith, 1996), 6,446,751 (Ahuja et al., 2002), 4,017,917 (Brown, 1977), 4,305,168 (Holter et al., 1981), 4,594,817 (McLaren et al., 1986), 5,669,088 (McNamee, 1997), 6,308,466 (Moriarty, 2001), 4,641,387 (Bondy et al., 1987), 5,384,925 (Vail, 1995), 6,216,291 (Eads et al., 2001), 6,263,529 (Chadwick et al., 2001), 6,487,735 (Jacques et al., 2002), 6,694,547 (Vail, 2004), 6,772,458 (Ellen et al., 2004), 7,047,991 (Kline, 2006), 7,380,296 (Ellen et al., 2008), and 7,434,280 (Cyr, 2008), and U.S. Patent Application 20070294827 (Carr et al., 2007). Examples of sound-insulating structures for sleeping that are relatively fully-enclosed include the following: U.S. Pat. Nos. 4,109,331 (Champeau, 1978), 4,129,123 (Smidak, 1978), 4,937,903 (Joly et al., 1990), 6,461,290 (Reichman et al., 2002), 6,508,850 (Kotliar, 2003), and 6,827,760 (Kutt et al., 2004).

SUMMARY OF THIS INVENTION

This invention is a sound-insulating enclosure, in which one or more people sleep, whose configuration automatically changes over time from a more open configuration to a more closed configuration, or vice versa. Its configuration may change in response to changes in environmental sounds or in a pre-programmed manner. Environmental sounds may be monitored by a microphone and analyzed by software. Moving parts of the sleeping enclosure can move so that the enclosure more fully encloses sleepers in response to certain sounds or sound levels and less fully encloses sleepers in response to the absence of certain sounds or sound levels.

This invention includes active ventilation with safeguards to assure proper ventilation regardless of the degree of enclosure. Active ventilation can be accomplished by an electric fan or air pump. This invention can also feature back-up passive ventilation in case the active ventilation fails. As an additional safety measure, it may also have a battery-operated alarm triggered by high carbon dioxide, low oxygen, or other unhealthy air parameters within the enclosure.

This invention can be used to selectively prevent sleep-disturbing environmental sounds (such as loud music; train, street and air traffic; noisy neighbors; or barking dogs) from reaching a sleeping person. This invention can also be used to selectively prevent sleep-disturbing sounds emitted by one sleeping person (such as snoring or sleep talking) from reaching another sleeping person.

Several options can be used to supplement the core concept of the invention. The sound monitoring and analyzing means may selectively identify certain sounds that the sleeper does wants to hear (such as important alarms or the voices of the sleeper's family members) and may selectively transmit those sounds to the sleeper within the enclosure. Also, characteristics of the environment within the enclosure may be adjusted. Adjusted characteristics may include light level, light patterns, temperature level, humidity level, active noise masking, and soothing sounds or music.

INTRODUCTION TO THE DRAWINGS

These figures and the accompanying narrative show and discuss different examples of how this invention may be embodied. However, these examples do not limit the full generalizability of the claims.

DETAILED DESCRIPTION OF THE DRAWINGS

These figures and the accompanying narrative show and discuss different examples of how this invention may be embodied. However, these examples are not exhaustive. These figures do not limit the full generalizability of the claims.

Figure 1:
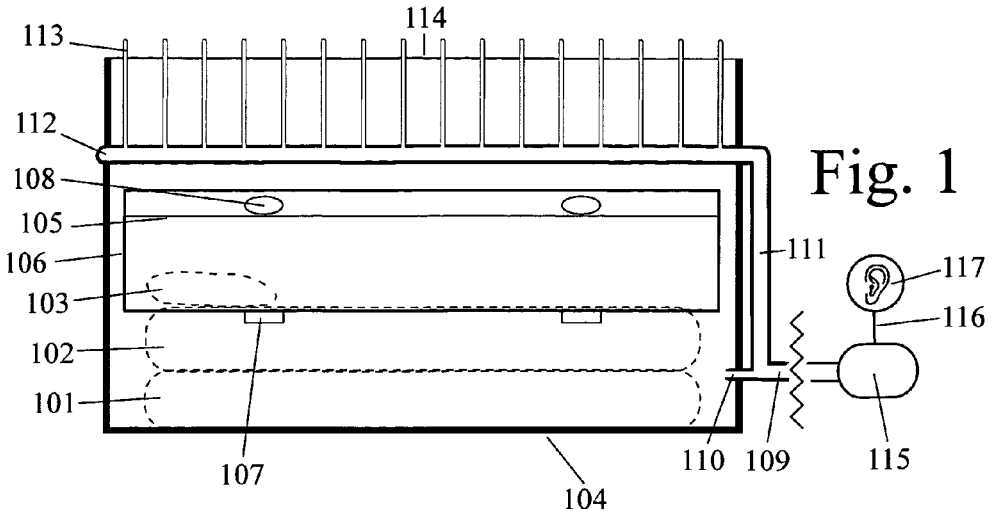
FIGS. 1 through 3 show side, top-down, and rectangular-end perspectives of an embodiment of this invention in a relatively-open configuration during a period of relatively-low environmental noise.
Figure 2:
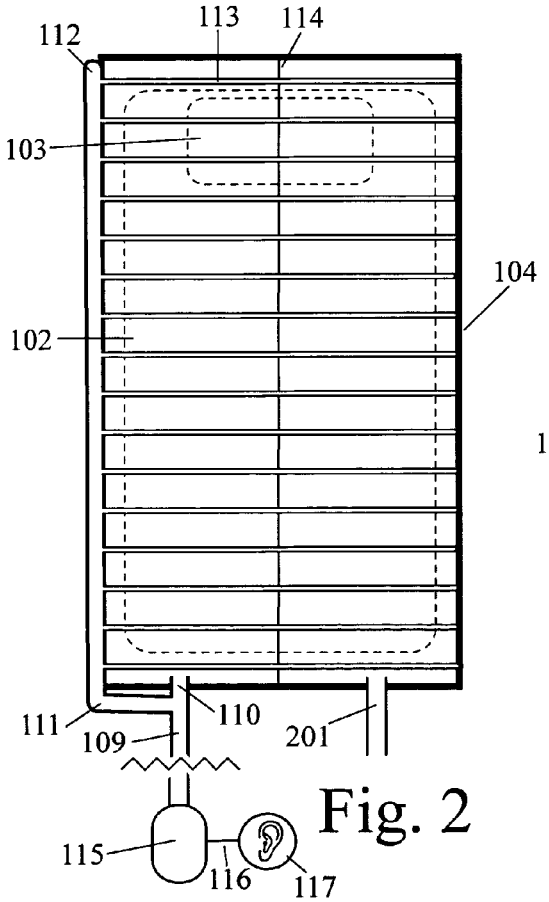
Figure 3:
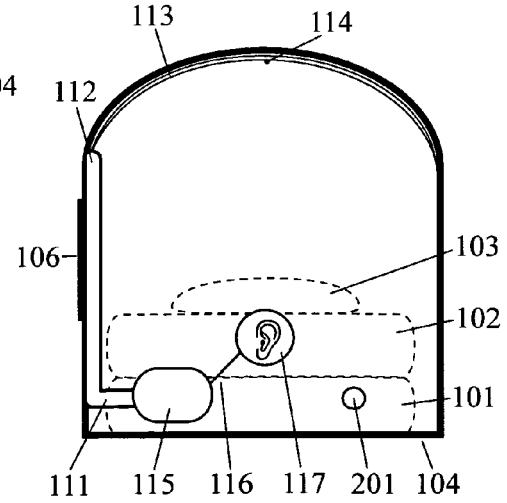

FIGS. 1 through 3 show three different views (side, top-down, and rectangular-end perspectives) of an embodiment of this invention in a relatively-open configuration when there is a low level of environmental noise. This particular embodiment contains a bed, has a rectangular horizontal cross-section, and has a ceiling that is formed by parallel, arched, longitudinal inflatable members. When there are low levels of environmental noise then: the inflatable members of the ceiling are uninflated, there are large gaps between these inflatable members, the ceiling is largely open, and the enclosure has a relatively open configuration. When there are high levels of environmental noise then: the inflatable members of the ceiling are inflated, there are no gaps between these inflatable members, the ceiling is closed, and the enclosure has a relatively closed configuration. FIGS. 1 through 3 show this embodiment in an open configuration during low noise. Subsequent figures show this embodiment in a closed configuration during high noise.

The open configuration of this enclosure offers the benefits of "open space aesthetics" and natural passive ventilation, but does not provide good insulation from environmental noise. The closed configuration of this enclosure provides good insulation from environmental noise, but does not offer "open space aesthetics" and natural passive ventilation. In the closed configuration, an active ventilation system circulates fresh air through the enclosure. A key innovation of this invention is that it can automatically change from a relatively-open configuration to a relatively-closed configuration, or vice versa, in response to changes in the levels or types of environmental noises or a pre-programmed pattern. Intelligent dynamic response to environmental noise always provides the sleeper with the optimal balance between partial or full enclosure. This capability is not provided by the prior art.

This invention further opens up a whole range of possibilities for programming changes in partial or full enclosure over time. For example, suppose that the sleeper lives next to a railway on which a train rumbles through between 3:15 am and 3:45 am each night. The sleeper could drift off to sleep around 10 pm with the enclosure in an open configuration with passive ventilation. However, the sleeper could program the enclosure to quietly inflate the inflatable members and switch to a closed configuration with active ventilation at 3 am and to quietly deflate the inflatable members and return to an open configuration at 4 am. With this programmable capability, the sleeper could drift off to sleep in an open structure and wake up in an open structure, but completely tune out the train rumble in a closed configuration in the dead of the night. If the timing of night trains is completely unpredictable, then the enclosure could monitor environmental noise and automatically switch to a closed configuration in response to a certain level, duration, or type of noise.

FIG. 1 shows a side view of this embodiment. In this embodiment, the walls of the enclosure are transparent and there is no internal light source. In another example, the walls of the enclosure may be opaque and there may be an internal light source. Such an internal light source could be adjusted to create a light environment within the enclosure that is independent from the light environment outside the enclosure. The air conduits and inflatable members shown in FIG. 1 are shown in a cross-sectional (semi-transparent) perspective to highlight the continuity of passageways for air ventilation. In the actual physical embodiment of this invention, these conduits and inflatable members would likely be opaque.

FIG. 1 shows box spring 101, mattress 102, and pillow 103 within sound-insulating sleeping enclosure 104. Box spring 101, mattress 102, and pillow 103 are shown using dashed lines in this figure because they are not central to the invention, but they are useful for providing context. In another example, a sleeping bag, water bed, sleeping pad, or other surface for rest or relaxation could be within the enclosure instead of a regular bed. In this example, the sleeping enclosure has a rectangular horizontal cross-sectional shape. In other examples, the sleeping enclosure may have a circular, oval, egg-shaped, octagonal, or other convex cross-sectional shape. In this example, the sleeping enclosure has an arched ceiling. In other examples, the sleeping enclosure may have a flat ceiling or a dome ceiling.

In this embodiment, sleeping enclosure 104 contains a single bed for one person. In another example, the sleeping enclosure may contain a queen-size bed for two people or it may contain two separate beds. In a variation on the version for two people, the sleeping enclosure may have a sliding panel that can optionally separate the air space between the two people. Such a sliding panel may be useful if one person snores, but both people still wish to sleep near each other. In a variation on the snoring example, the sliding panel may automatically and silently close to separate the airspace in response to snoring sounds during the night. In another example, a sliding panel may also be useful if one person is sick and might infect the other person by coughing during the night. In examples involving a sliding panel, there would be separate ventilation systems for each side of the airspace.

In this embodiment, the walls of the sound-insulating enclosure are transparent and the wall panels contain a partial vacuum to reduce sound transmission. In other examples, the walls of the sound-insulating enclosure may be opaque and contain synthetic or natural acoustic insulation material. Acoustic insulating materials can be selected from the group consisting of: polymerics, polyolefins, polystyrenes, polyurethanes, olyethylenes, polyimides, neoprenes, other synthetic materials, mineral wool, textile fibers, wood fibers, and other natural fibers.

In the embodiment shown in FIG. 1, rectangular hole 105 in the side of enclosure 104 is a portal by which a sleeper enters or exits the sleeping enclosure 104. In this embodiment, rectangular hole 105 has a length that is slightly longer than mattress 102, has a height that is approximately two times the height of mattress 102, and has a bottom edge approximately the same height from the floor as the top of mattress 102. In FIG. 1, rectangular hole 105 is covered by a transparent, rectangular, sound-insulated side panel 106 that tilts on two hinges, including hinge 107. In FIGS. 1 through 3, side panel 106 is tilted upwards to cover rectangular hole 105. Later figures will show how side panel 106 looks when it is tilted downwards to uncover rectangular hole 105 in order to allow the sleeper to enter or exit enclosure 104.

Side panel 106 is slightly larger than rectangular hole 105 so that it overlaps with enclosure walls 104 in order to provide a sound-insulating seal and to allow hook-and-loop pad pairs, including 108, to stick to each other. One part of each hook-and-loop pad pair 108 is on side panel 106 and the other part is on the enclosure wall 104. Side-panel 106 is attached along its bottom edge to the enclosure 104 by two hinges, including 107, and is attached along its top edge to enclosure 104 by two separable hook-and-loop pad pairs, including 108. This attachment configuration allows the sleeper to exit the enclosure by simply pushing outwards on the top of side panel 106. This causes the hook-and-loop pads on enclosure wall 104 and side panel 106 to separate and the side panel 106 to tilt downwards.

In this example, opening 105 through which a sleeper enters or exits the enclosure is rectangular and the side panel 106 that covers it is rectangular and tilts downward to uncover the opening. In another example, the sleeping enclosure may have a circular horizontal cross-sectional shape. With a circular shape, the opening through which a sleeper enters or exits the enclosure may be curved and the side panel that covers it may be curved as well. In this latter example, the curved side panel may slide on circular tracks around the circle in order to open or close the opening.

FIG. 1 shows air conduits 109 and 110 that are part of an active means of ventilating sleeping enclosure 104. Air conduit 109 conducts air from automated air moving means 115. The zig-zag line separating section 109 of the air conduit from the continuation of the air conduit connected to automated air moving means 115 indicates a spatial discontinuity in the figure. The actual distance of the conduit between enclosure 104 and air moving means 115 is greater than that shown in the figure. Locating automated air moving means 115 some distance from the enclosure helps to reduce sound entering the enclosure in two ways. First, the distance reduces the sound generated by the automated air moving means that travels through the conduit to enter the sleeping enclosure. Second, the distance reduces the sound from environmental sources that travels through the conduit into the sleeping enclosure.

There is less sound from environmental sources entering the enclosure through a relatively long conduit with an active ventilation means than would enter the enclosure through direct openings or screens in the enclosure wall. Accordingly, an active ventilation means can provide better insulation against environmental sounds than a passive ventilation means.

In this embodiment, automated air moving means 115 is an electric fan. In another example, it could be an air pump or some other automated means of circulating fresh air through the enclosure when it is in a closed configuration. Automated air moving means 115 is turned on or off by a sound monitoring and analyzing unit 117 via wire 116 that connects them. In this embodiment, FIGS. 1 through 3 show the situation wherein the environmental noise levels monitored and analyzed by unit 117 are at a relatively low level. In this low noise situation, unit 117 turns off the automated air moving means 115, the inflated members of the ceiling deflate, the ceiling opens up for passive ventilation, and the enclosure is in an open configuration.

In FIG. 1, air inflow conduit 109 splits into two branches. Air conduit 110 that brings fresh air into sleeping enclosure 104. Air conduit 111, which turns into conduit 112, that inflates the parallel arched longitudinal members, including 113, that form the ceiling of the enclosure. The purpose of this branching is to ensure that the only time that the longitudinal members forming the ceiling are inflated is when there is active air flow into the enclosure. If the active air flows stops, then the longitudinal members deflate and gaps between them allow passive ventilation. This linkage is a key ventilation safety feature of this invention. This linkage ensures that there is always one type of ventilation of the enclosure—there is either active ventilation through the automated air moving means sending air into the enclosure through conduit 109 or there is passive ventilation through the gaps between uninflated longitudinal members, including 113.

When the arched longitudinal members, including 113, are not inflated, there are large gaps between them, making the ceiling of the enclosure largely open to allow passive ventilation. When the arched longitudinal members, including 113, are inflated, then the gaps between them close and the ceiling becomes sound insulating. This configuration of air conduits (109, 110, 111, and 112) ensures that the longitudinal members (including 113) are only inflated when there is active ventilation of the enclosure. If for any reason the active airflow fails, then the longitudinal members deflate and passive ventilation occurs. In an optional add-on to this core invention, there may also be a third-level safety feature comprising a battery-powered alarm that monitors the air inside the enclosure and sounds an alarm in case of high CO2 level, low oxygen level, or some other indicator of unhealthy air.

In this example, the air conduits are configured so that the air entering conduit 111 and inflatable members, such as 113, has a higher pressure than the air within enclosure 104 when the automated air moving means is operating. In this example, air conduit 111 has a larger diameter than air conduit 110.

Roof peak rod 114, going across the peak of the arched ceiling, holds the longitudinal inflatable members up in an arched position. This is important so that these members: do not droop down into the enclosure when they are deflated; and so that they are relatively aligned, without gaps, when they are inflated.

FIG. 2 shows the same embodiment as shown in FIG. 1, but from a top-down perspective. This top-down view clearly shows the rafter-like configuration of the longitudinal arched inflatable members, including 113, that span the ceiling of the enclosure. In FIGS. 1 through 3, these members are uninflated, so there are large gaps between them. This allows passive ventilation of the enclosure. Subsequent figures will show what they look like when they are inflated. All of the components shown in FIG. 2 were first introduced in FIG. 1, except for outflow air conduit 201. Outflow air conduit 201 was obscured by inflow air conduit 109 in the side perspective of FIG. 1.

In different variations of this embodiment, the flow of air into the enclosure through conduit 109 and the flow of air out of the enclosure through conduit 201 may be set so that the air pressure within the enclosure is greater than, equal to, or less than that of the air pressure outside the enclosure. The main focus of this invention is on ensuring ventilation while providing sound insulation, not relative air pressure inside vs. outside the enclosure. Nonetheless, the ability to create a safely-ventilated higher-pressure sleeping environment may be very useful for some applications, such as treatment of sleep apnea without the need for a mask. It may even be possible to link the operation of this enclosure with clinical monitoring of a sleeper's breathing patterns, so that the enclosure closes up and increases air pressure within the enclosure in response to apnea-related breathing interruptions.

FIG. 3 shows this same embodiment from a rectangular-end perspective, looking at the end of the enclosure where the foot of the bed is located. All of the components shown in FIG. 3 were first introduced in FIG. 1 or 2. In this embodiment, air inflow conduit 109 and air outflow conduit 201 are both along the same end and located at approximately the mid-height of the box spring. In another example, these airflow conduits may be located at opposite ends of the enclosure to encourage greater circulation throughout the entire enclosure. However, having conduits at opposite ends may expose the person sleeping to more noise if noise enters the enclosure through the air flow conduit at the head of the bed.

Figure 4:
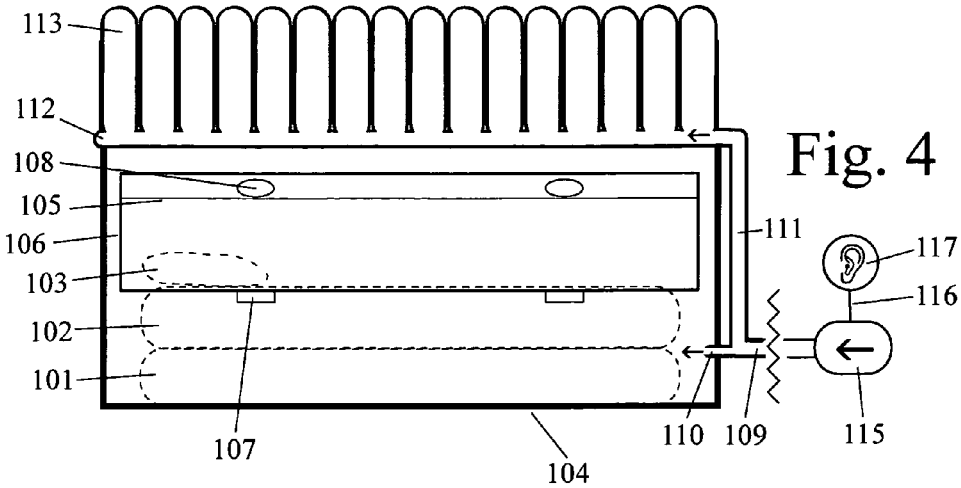
FIGS. 4 through 6 show side, top-down, and rectangular-end perspectives of this embodiment of this invention in a relatively-closed configuration during a period of relatively-high environmental noise.
Figure 5:
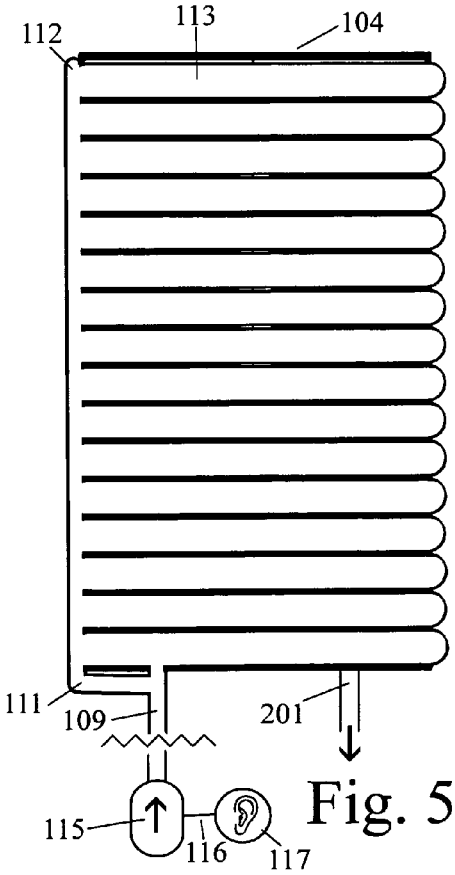
Figure 6:
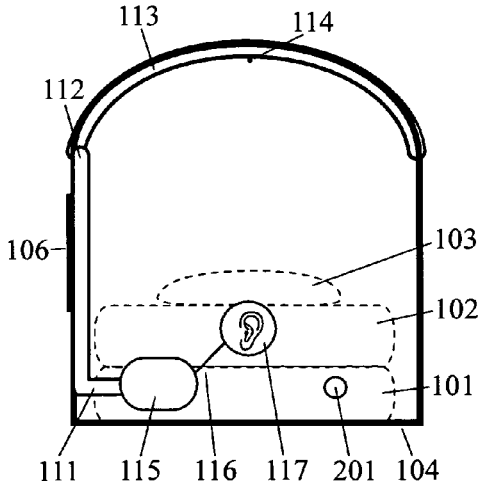

FIGS. 4 through 6 show the same three views (side, top-down, and rectangular-end perspectives) of the embodiment of this invention that was shown in FIGS. 1 through 3, except that now the sound monitoring and analyzing unit 117 has detected a high level of environmental noise and the enclosure is in a closed configuration. The sound monitoring and analyzing unit 117 has detected a high level of environmental noise and turned on active ventilation system 115. This system inflates the longitudinal arched inflatable members spanning the ceiling, thereby closing the gaps between them and causing the enclosure to be in a closed configuration. This configuration is does not offer "open space aesthetics," but does provide full insulation from environmental noise.

As an example of how this enclosure might automatically respond to changes in environmental noise, suppose that the sleeper lives next door to a bar that plays bass-thumping music each night until some time between 2 am and 4 am. When the sleeper goes to bed at 10 pm, the bar is hopping and bass-thumping music comes through the walls into the sleeper's bedroom. This noise is detected by the sound monitoring and analyzing unit 117, so that active ventilation 115 is turned on, the longitudinal members of the ceiling are inflated, and the sleeper is largely insulated from the thumping bass sounds. Thus, the sleeper can drift off to sleep in peace. Later at night, around 3 am, the bar finally closes down. After around 15 minutes of continuous silence, the sound monitoring and analyzing unit 117 shuts down operation of active ventilation 115, the longitudinal members deflate, the ceiling opens up, the enclosure changes to an open configuration, and passive ventilation occurs.

In a different example, suppose all is quiet and calm when a sleeper goes to bed at 10 pm. The active ventilation system 115 is not operating, the ceiling is open, and passive ventilation occurs. However, around 3 am, the neighbor's crazy dog begins its annoying routine of yowling at a telephone poll for an hour or two. The sound monitoring and analyzing unit 117 detects the barking and turns on the active ventilation system 115, the gaps in the ceiling close, and the sleeper is fully insulated from the canine cacophony. With sophisticated sound monitoring and sound analysis software, the enclosure might even be able to respond by switching to a closed configuration before the barking even wakes up the sleeper.

An arrow on the right side of FIG. 4 pointing into inflow air conduit 109 indicates that air is now flowing into conduit 109 from automatic airflow means 115. The flow of air traveling into air conduit 109 branches into air conduit 111 and air conduit 110. The portion of the air flow that goes into air conduit 111 enters upper air conduit 112 and then inflates longitudinal arched members, including 113. When these arched members are all inflated, then the gaps between them are closed and they collectively create a continuous sound-insulating surface on the ceiling of the enclosure 104.

The portion of the air flow that goes into air inflow conduit 110 enters the sleeping enclosure to provide ventilation for the sleeping person. In this example, this airflow later exits the enclosure through air outflow conduit 201. Outflow conduit 201 was introduced in FIG. 3 and is shown again in FIG. 6. As mentioned earlier, the net balance between air inflow and outflow may be adjusted to create air pressure within the enclosure that is lower than, equal to, or greater than the air pressure outside the enclosure. Having low, equal, or high pressure in different examples of this invention may be advantageous for different applications. For example, a sleeping enclosure with higher pressure and ventilation assurance safeguards may be therapeutically innovative and useful for sleepers with sleep apnea.

Figure 7:
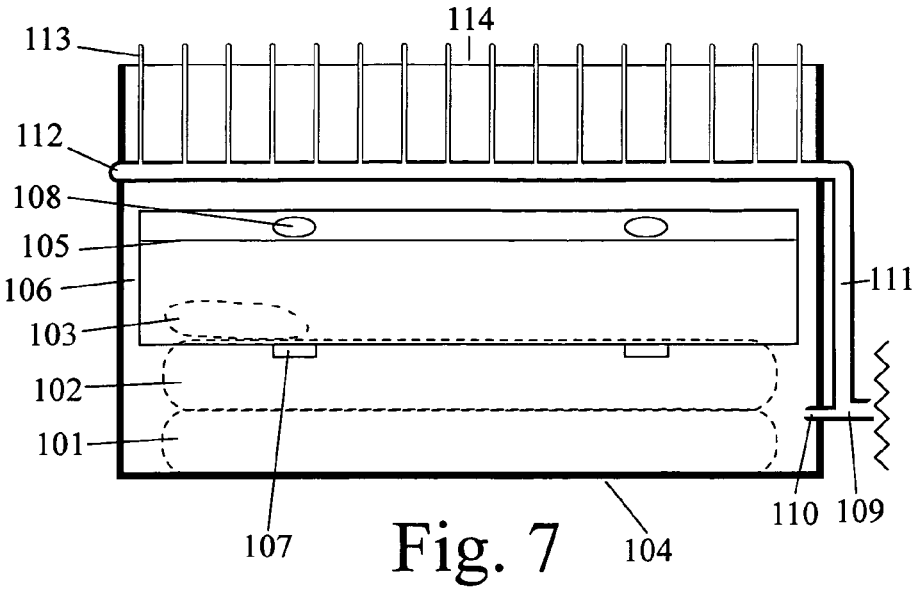
FIGS. 7 and 8 show details concerning one way in which a sleeper may enter or exit the enclosure.
Figure 8:
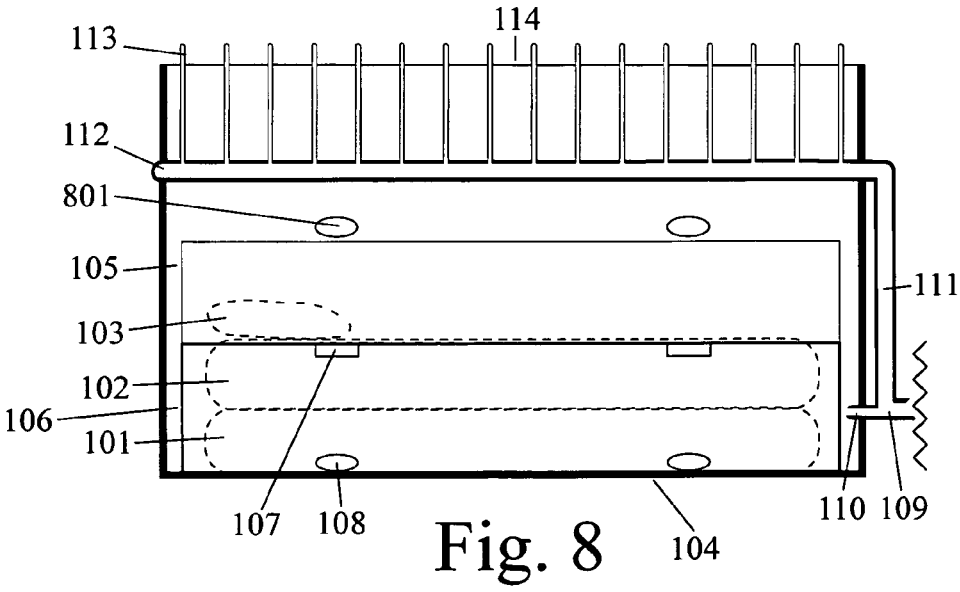

FIGS. 7 and 8 show details concerning one way in which a sleeper may enter or exit the enclosure. FIG. 7 shows rectangular moveable side panel 106 in an upward position where it covers rectangular hole 105 in enclosure wall 104. In this upward position, the lower edge of rectangular side panel 106 is attached to the enclosure with two hinges, including hinge 107, and the upper edge of the rectangular side panel 106 is attached to the enclosure with two loop-and-hook pads, including loop-and-hook pad 108. In this configuration, rectangular side panel 106 overlaps the enclosure and provides a sound-insulating seal.

FIG. 8 shows rectangular side panel 106 having been tilted downward, pivoting via the two hinges, including 107. This downward movement uncovers hole 105 in the enclosure wall 104 so that a sleeper can enter or exit the enclosure. This movement can be easily initiated from inside the enclosure by the sleeper simply pushing against the top of side panel 106. This pushing detaches the loop pad on the enclosure wall from the corresponding hook pad at the top of the rectangular panel. This causes the panel to move away from the enclosure and tilt downward. Such a method of easy and intuitive egress from the enclosure is important to avoid feelings of claustrophobia and to provide easy egress in case of an emergency.

The embodiment shown in FIGS. 1 through 8 focuses on the primary and innovative aspects of this invention in order to convey the invention clearly. There are, however, several useful options that one could add. For example, options could be added that modify other characteristics of the environment within the sleeping enclosure. For example, options could be added that provide active sound production within the sleeping enclosure—such as active sound masking, soothing sounds, or music within the enclosure. In other examples, options could be added that modify light, temperature, air pressure, or air quality within the enclosure. For example, air filtering could be added to provide cleaner air within the enclosure than outside the enclosure.

In other examples, options may be added that provide selective communication with the external environment. For example, sound monitoring and analyzing means could be added to selectively recognize and transmit sounds that the sleeper wants to hear, such as external safety alarms, telephones, baby monitors, intercoms, or specific human voices. As an example, sophisticated voice recognition technology could identify and actively transmit voices from members of one's family, but could block out the voices of rowdy neighbors.

This invention is designed so that a means of passive ventilation is assured if the active ventilation system stops for any reason. In this example, the default position of the longitudinal inflatable members spanning the ceiling of the enclosure is a deflated position, allowing ample passive ventilation for the enclosure. The only way that the longitudinal inflatable members expand to seal off the enclosure from both sound and passive ventilation is by airflow from operation of the active ventilation system. Having said this, for even greater safety, a tertiary safety feature such as a battery operated high CO2 or low oxygen alarm may also be added to the enclosure.

I claim:

1. A sound-insulating sleeping enclosure, in which one or more people sleep, with a configuration that changes automatically, comprising:

a sound-monitoring means;

a sound-insulating sleeping enclosure, in which one or more people sleep, wherein this sleeping enclosure contains at least one bed, wherein this sleeping enclosure has inflatable parts whose inflation increases the degree to which the enclosure encloses one or more sleepers, and wherein these inflatable parts are inflated automatically in response to sounds monitored by the sound-monitoring means so as to change the configuration of the enclosure from a more-open configuration to a more-closed configuration; and an active ventilation system, wherein circulation of fresh air through the enclosure by this active ventilation system is automatically increased in response to sounds monitored by the sound-monitoring means.

2. The sleeping enclosure in claim 1 wherein sounds monitored by the sound-monitoring means come from the group consisting of: music; noise from trains, road traffic, or air traffic; sirens; manufacturing equipment; human voices; human snoring; and barking dogs.

3. The sleeping enclosure in claim 1 wherein the inflatable parts are inflated automatically so that: the enclosure more fully encloses a sleeper in response to a certain level, pattern, or type of sound for a certain duration of time; the enclosure less fully encloses a sleeper in response to the absence of a certain level, pattern, or type of sound for a certain duration of time; or both.

4. The sleeping enclosure in claim 1 wherein inflatable parts of the enclosure are inflated automatically to change the configuration of the enclosure in a pre-programmed manner over time.

5. The sleeping enclosure in claim 1 wherein the sound-monitoring means includes a microphone and sound-analyzing software.

6. The sleeping enclosure in claim 1 wherein the enclosure includes a ventilation means that provides active ventilation of the enclosure using a member selected from the group consisting of: an electric fan, an air pump, and other automated devices for moving air.

7. The sleeping enclosure in claim 1 wherein the enclosure includes a ventilation means that provides passive ventilation of the enclosure using a member selected from the group consisting of: openings in the enclosure perimeter, air-permeable screens in the enclosure perimeter, and other means of passive ventilation not requiring an automated device to move air.

8. The sleeping enclosure in claim 1 wherein the enclosure includes a ventilation means that automatically increases ventilation in response to increases in the extent to which a sleeper is enclosed by the enclosure; automatically decreases ventilation in response to decreases in the extent to which a sleeper is enclosed by the enclosure; or both.

9. The sleeping enclosure in claim 1 wherein the enclosure has a horizontal cross-sectional shape selected from the group of shapes consisting of: rectangular, square, circular, oval, egg-shape, hexagonal and octagonal.

10. The sleeping enclosure in claim 1 wherein a battery-operated alarm is added within the enclosure to warn of high carbon dioxide, low oxygen, or other unhealthy air parameters within the enclosure as a tertiary safety measure.

11. The sleeping enclosure in claim 1 wherein a mechanism selectively identifies certain sounds outside the enclosure and selectively transmits those sounds that the sleeper wants to hear.

12. The sleeping enclosure in claim 1 wherein characteristics of the environment within the enclosure may be adjusted and wherein these characteristics are selected from the group consisting of: light level, light patterns, temperature level, humidity level, active noise masking, and soothing sounds or music.

13. The sleeping enclosure in claim 1 wherein the sound-insulating enclosure is large enough for two sleepers and contains a movable divider that can optionally divide the airspace between the two sleepers to provide two separate sound environments for them.

14. A sound-insulating sleeping enclosure, in which one or more people sleep, with a configuration that changes automatically, comprising:

a sound-identification means, wherein this sound-identification means analyzes sound patterns to identify a specific type of sound selected from the group consisting of: music; noise from a train, road traffic, or air traffic; sirens; manufacturing equipment; a human voice; human snoring; and a barking dog;

a sound-insulating sleeping enclosure, in which one or more people sleep, wherein this sleeping enclosure contains at least one bed, wherein this sleeping enclosure has moving parts whose movement changes the degree to which the enclosure encloses one or more sleepers, and wherein these moving parts move automatically so as to change the configuration of the enclosure from a more-closed configuration to a more-open configuration, or vice versa; and wherein the moving parts move automatically in response to a specific type of sound selected from the group consisting of: music; noise from a train, road traffic, or air traffic; sirens; manufacturing equipment; a human voice; human snoring; and a barking dog; and an active ventilation system, wherein circulation of fresh air through the enclosure by this active ventilation system is automatically activated or increased in response to a specific type of sound selected from the group consisting of: music; noise from a train, road traffic, or air traffic; sirens; manufacturing equipment; a human voice; human snoring; and a barking dog.

* * * * *